United States Patent [19]

Priddy

[11] Patent Number: 4,732,470

[45] Date of Patent: Mar. 22, 1988

[54] PARALLAX ERROR MEASUREMENT DEVICE

[75] Inventor: Randolph W. Priddy, Huntsville, Ala.

[73] Assignee: The United States of America as represented by the Secretary of the Army, Washington, D.C.

[21] Appl. No.: 865,995

[22] Filed: May 22, 1986

[51] Int. Cl.[4] ..... G01B 9/00

[52] U.S. Cl. ..... 356/124

[58] Field of Search ..... 356/124, 124.5, 125, 356/126, 127

[56] References Cited

U.S. PATENT DOCUMENTS 3,708,619 1/1973 Martin ..... 356/125

OTHER PUBLICATIONS

Sukhoparov, *Optical Technology,* vol. 37, No. 10, Oct. 1970, pp. 649-651.

*Primary Examiner*—F. L. Evans

*Attorney, Agent, or Firm*—Freddie M. Bush; Robert C. Sims

[57] ABSTRACT

The Parallax Error Measurement Device (PEMED) is an instrument used to measure parallax error associated with military night sights and other sights containing reticles. The PEMED consists of the following components: aperture translation stage; camera lens positioning and translation stage; coherent fiber optic image transfer bundle; automated translation stage controller; low light level camera; video wave form monitor and storage oscilloscope. The measurement concept involves the principle of translating an aperture across a relatively large collecting optic instead of translating the collecting optic itself. This technique eliminates alignment and focus errors which might occur when the collecting optic is translated. The aperture translation stages are driven by servo motors under computer control where a positive verification signal is monitored by the computer after each specific translation distance is achieved. The entire PEMED is designed to operate remotely inside of an environmental chamber such as that used to condition and test equipment at extreme temperatures. Moving parts associated with parallax measurements are restricted to the aperture plate between the eyepiece objective lens and the camera objective lens. The aperture plate is initialized prior to each parallax measurement and the entire measurement is conducted in a short period of time (approximately one minute), therefore, cancelling the effects of temperature on the other components such as the test item mount, camera lens, and ancillery components.

6 Claims, 2 Drawing Figures

PARALLAX ERROR MEASUREMENT DEVICE

DEDICATORY CLAUSE

The invention described herein may be manufactured, used, and licensed by or for the Government for governmental purposes without the payment to me of any royalties thereon.

BACKGROUND OF THE INVENTION

Parallax is the apparent displacement of an observed object due to the point of view of the observer. This is an important measurement parameter for various sighting devices especially those incorporating a sighting reticle. For such optical devices, parallax error occurs when the focal plane of the target (or object) image does not coincide with that of the reticle. When parallax error is present, a change in the observer's viewing position will cause the observed target image to appear to move with respect to the reticle cross hairs, thereby inducing an error in sighting registration.

The usual method of measuring parallax error is to translate a telescope across the viewing optics and measure the apparent displacement. Disadvantages of this technique are:

a. A high precision telescope is required that, in itself, must be relatively free of parallax.

b. The technique is generally labor intensive in that a human observer is required or a video imaging system must be adapted requiring constant attention by an operator. Such systems are not suitable for measurement in temperature extremes such as that produced by an environmental test chamber. Care must be taken to insure that the parallax error measured is exclusively that of the system being measured and is not biased by the instrumentation used to conduct the measurement.

c. The degree of resolution in the order of microradians is difficult and expensive to achieve.

Parallax error in certain optical sighting devices such as night sights, varies according to the ambient and operating temperatures of the optical elements and mounting fixtures. A need exists to measure parallax at various temperatures inside of environmental test chambers. The parallax measurement device has been developed to meet this need.

The purpose of this invention is to provide a high precision automated instrument to measure parallax error at various temperatures.

SUMMARY OF THE INVENTION

The Parallax Error Measurement Device (PEMED) is an instrument used to measure parallax error associated with military night sights and other sights containing reticles. The PEMED consists of the following components: aperture translation stage; camera lens positioning and translation stage; coherent fiber optic image transfer bundle; automated translation stage controller; low light level camera; video wave form monitor and storage oscilloscope.

The measurement concept involves the principle of translating an aperture across a relatively large collecting optic instead of translating the collecting optic itself. This technique eliminates alignment and focus errors which might occur when the collecting optic is translated.

The aperture translation stages are driven by servo motors under computer control where a positive verification signal is monitored by the computer after each specific translation distance is achieved. The entire PEMED is designed to operate remotely inside of an environmental chamber such as that used to condition and test equipment at extreme temperatures. Moving parts associated with parallax measurements are restricted to the aperture plate between the eyepiece objective lens and the camera objective lens. The aperture plate is initialized prior to each parallax measurement and the entire measurement is conducted in a short period of time (approximately one minute), therefore, cancelling the effects of temperature on the other components such as the test item mount, camera lens, and ancillery components. Accuracy is thus increased because the parallax error measurement itself is isolated from the effects of the temperature extremes.

DETAILED DESCRIPTION OF THE PREFERRED EMBODIMENT AND BEST MODE

Figure 1:
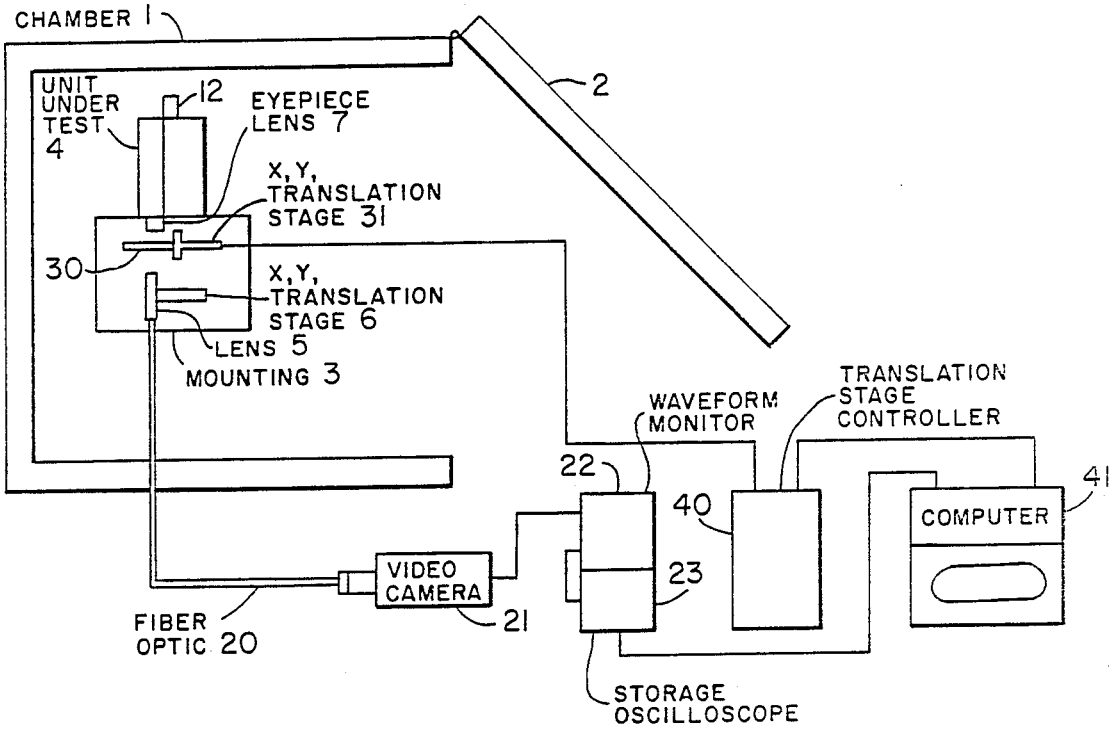
FIG. 1 is a functional sketch of the parallax error measurement device configured for operation in an environmental test chamber.
Figure 2:
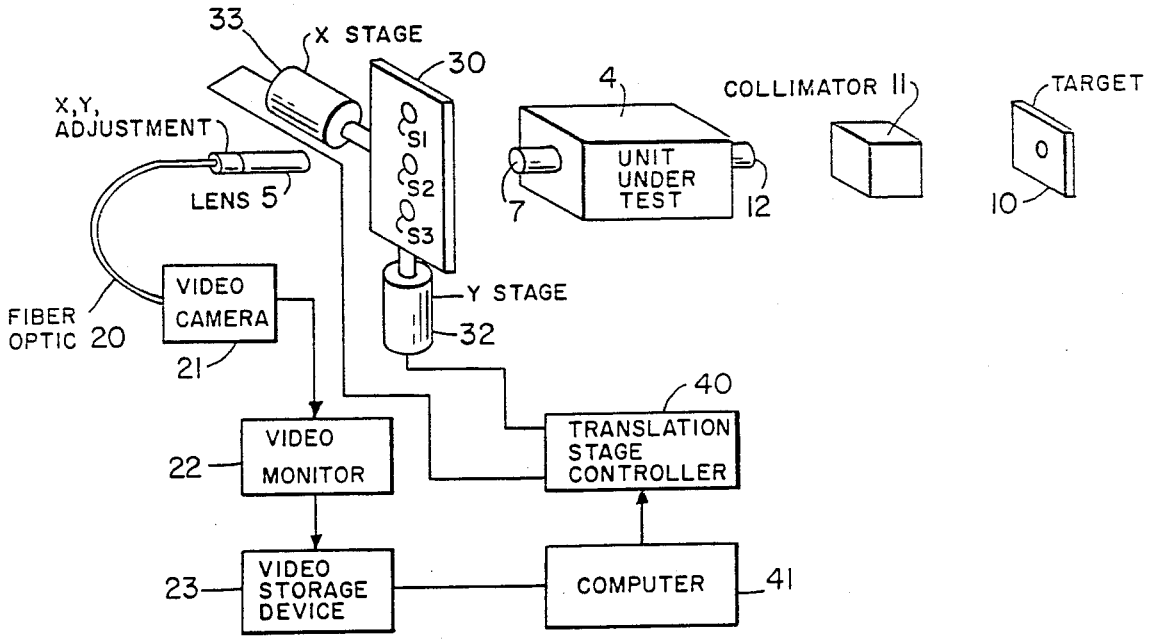
FIG. 2 is a diagrammical and block diagram of the present invention.

FIGS. 1 and 2 illustrate the present invention. A hermetically sealed environmental test chamber 1 is provided with a lid 2 for access to the chamber. Mounting means 3 are broadly shown for mounting the night sight test item 4 and for mounting the detecting lens 5. An X, Y translating stage 6 is mounted between the lens 5 and the mounting 3 so that the lens 5 can be mounted and adjusted so that it is boresighted on the eyepiece lens 7 of the test item 4.

The nightsight 4 can be electronically caused to generate a single cell to light. This can be adjusted such that it will be about the center of the cross hairs of the eyepiece. Another method of generating a part about the center of the cross hairs would be the use of a target 10 having a illumination in the center thereof and a collimator 11 innerposed between the target 10 and the receiving optics 12 so as to make the target look as if it were an infinite distance away with respect to focal plane. In both cases the receiving lens 5 will send the image through fiber optics bundle 20 to the low light video camera 21.

A flat aperture plate 30 is positioned between the lenses 5 and 7. An X, Y translation stage 31 provides for movement of the aperture plate 30. FIG. 2 broadly shows a Y-stage motor 32 and an X-stage motor 33 mounted to the plate 30 for control of the movement of plate 30. A translation stage controller 40 which is coupled to a computer 41 provides automatic control for the movement of the aperture plate 30. Any of the well known mounting arrangements can be used to facilitate the movement.

The aperture plate 30 is equipped with 3 apertures S1, S2, and S3 to permit selection of the aperture of choice. The larger the aperture the greater the area of integration conversely, the smaller the aperture the more representative of a parallax error at a finite point. The aperture choice is made by movement of the Y stage motor 32. Then the aperture plate 30 is automatically controlled by the computer to traverse in stages across the X axis both positive and negative and the video output generated by camera 21 is fed to monitor 22 and to storage oscilloscope 23 for viewing and storage. The aperture plate is then brought back to zero point and is caused to traverse in the Y direction of both plus and minus by computer 41. This information is also stored. This two-line traversing of the eyepiece lens 7 should be sufficient to determine if the lens meets the parallax standards. However the computer could cause the aperture plate to traverse about the entire area of the eyepiece lens 7 if this was desired. Any of the well known video cameras, video monitor, stored oscillators, and computers can be used for the preformance of this invention. The determination of the exceptability of the lens can be made by an observer watching the monitor 22. This observer could also cause the movement of the aperture plate 30 but at the cost of considerable amount of manhours.

DESCRIPTION OF OPERATION

In practice, a parallax measurement machining cycle consists of positioning a night sight test item 4 on the test fixture 3, aligning the camera lens 5 to the center of the eyepiece optics 7, adjusting the video camera objective lens 5 to a setting of infinity and adjusting the night sight eyepiece objective lens 7 focus to the best reticle image, aligning the aperture plate 30 to bring the selected aperture to the center of the test item aperture lens, translating the aperture across the measurement plane and recording the relative position of the reticle with respect to the object (target) at each increment of movement. The relative distance between the target and the reticle line is determined by observing the position of the image centroid displayed on a storage oscilloscope 25. The parallax error is considered to be the magnitude of the change in distance between the reticle line and the target LED (generated intervial or from the target image) as the aperture plate 30 is translated from one edge of the night sight eyepiece field-of-view to the opposite edge of the field-of-view in a particular plane of measurement.

This invention provides a parallax error measurement device which is suitable for operation within environmental test chambers where:

a. After the test item and parallax test device are aligned, only two moving part are required to conduct parallax error measurements across an eyepiece optic. These moving parts consist of a flat aperture plate which is affixed to a vertial translation stage which in turn is affixed to a horizontal translation stage. Both translations are under computer control and can be operated when subjected to temperature extremes (−40 to +140 degrees Fahrenheit.)

b. Remote transfer of an optical image from the inside of an environmental chamber to a remote video camera by means of a coherent fiber optic cable, thus, permitting direct observation of the parallax phenomenon.

c. The use of a video signal to determine parallax error by measuring the relative shift in position between a tar get and a reticle line.

I claim:

1. A parallax error measurement device for measuring the parallax error in a lens of a center spot generated through said lens comprising a flat aperture plate having at least one orifice therein, a receiving optical means for recording optical information, a mounting means connected to said optical means and said lens for boresight alignment, translation means connected to said aperture plate, said translation means causing said aperture plate to move such that the orfice will transverse one edge of the lens to the other edge of the lens, and a video storage device connected to said optical means for evaluation of the parallax of said test lens.

2. A device as set forth in claim 1 wherein said aperture plate has a plurality of different size orifices; each being smaller than the size of the test lens.

3. A device as set forth in claim 2 wherein said translation means will select one orifice to translate across the testing lens.

4. A device as set forth in claim 3 wherein said translation means can cause the aperture plate to move and an X, Y plane about said test lens.

5. A system as set forth in claim 4 further comprising a chamber device enclosing said optical means, aperture plate, and said lens 3, and optics fiber connected between said optical means and said storage device whereby said storage device can be located outside of said chamber.

6. A device as set forth in claim 5 wherein said the lens is part of a camera device, video generation means associated with said camera for generating a spot of light about the center of said test lens.

* * * * *